US008707880B2

(12) United States Patent
Armstrong

(10) Patent No.: US 8,707,880 B2
(45) Date of Patent: Apr. 29, 2014

(54) TRIMARAN MOTION DAMPING

(75) Inventor: Neville Anthony Armstrong, Coogee (AU)

(73) Assignee: Austal Ships Pty Ltd., Henderson, Western Australia (AU)

( * ) Notice: Subject to any disclaimer, the term of this patent is extended or adjusted under 35 U.S.C. 154(b) by 47 days.

(21) Appl. No.: 13/376,026

(22) PCT Filed: Jun. 3, 2010

(86) PCT No.: PCT/AU2010/000687

§ 371 (c)(1),
(2), (4) Date: Feb. 20, 2012

(87) PCT Pub. No.: WO2010/139016

PCT Pub. Date: Dec. 9, 2010

(65) Prior Publication Data

US 2012/0132118 A1 May 31, 2012

(30) Foreign Application Priority Data

Jun. 3, 2009 (AU) ..... 2009902549

(51) Int. Cl.
*B63B 39/06* (2006.01)

(52) U.S. Cl.
USPC ..... 114/122; 114/61.1

(58) Field of Classification Search
CPC ..... B63B 1/12; B63B 1/121; B63B 1/107; B63B 39/06; B63B 43/04; B63B 35/4413; B63B 39/08; B63B 43/14; B63B 1/14
USPC ..... 114/61.1, 61.16, 122, 123, 126
See application file for complete search history.

(56) References Cited

U.S. PATENT DOCUMENTS

| | | | |
|---|---|---|---|
| 5,529,009 | A | 6/1996 | Faury et al. |
| 6,435,123 | B1 | 8/2002 | Odegard |
| 7,743,720 | B1 | 6/2010 | Salani |
| 2005/0126464 | A1 | 6/2005 | Lang et al. |

FOREIGN PATENT DOCUMENTS

| | | |
|---|---|---|
| WO | WO 93/12970 | 7/1993 |

OTHER PUBLICATIONS

International Search Report for International Application No. PCT/AU2010/000687 mailed Aug. 10, 2010.
Supplementary European Search Report for EP 10 782 830.3 mailed Nov. 27, 2013 (2 pages).
Communication accompanying the Supplementary European Search Report for EP 10 782 830.3 mailed Nov. 27, 2013 (2 pages).

*Primary Examiner* — Lars A Olson
(74) *Attorney, Agent, or Firm* — Merchant & Gould P.C.

(57) ABSTRACT

A multi-hulled vessel (10) configured as a trimaran. The multi-hulled vessel (10) comprises a main hull (15) and at least one outer hull (17) to each side of the main hull. The multi-hulled vessel (10) is provided with motion control means (40) for providing damping to wave-induced motion, thereby offering ride control. The motion control means (40) comprises a forward motion damping device (41) disposed adjacent the bow (25) of the main hull (15), and two aft dampening devices (43) disposed one adjacent the stern (33) of each side hull (17). With this arrangement, one of the motion damping devices (41, 43) is located at or near each apex of a notional triangular envelope (44) of the vessel (10). Each motion damping device (41, 43) is configured to resist wave-induced motion of the multi-hulled vessel (10) and thereby provide a damping effect. Each motion damping device (41, 43) may comprise an underwater hydrofoil (45), although other damping arrangements are possible.

13 Claims, 4 Drawing Sheets

TRIMARAN MOTION DAMPING

This application is a National Stage Application of PCT/AU2010/000687, filed 3 Jun. 2010, which claims benefit of Serial No. 2009902549, filed 3 Jun. 2009 in Australia and which applications are incorporated herein by reference. To the extent appropriate, a claim of priority is made to each of the above disclosed applications.

FIELD OF THE INVENTION

This invention relates to multi-hulled vessels configured as trimarans comprising a centrally located main hull and two side hulls. More particularity, the invention is concerned with trimarans incorporating motion control to provide damping to undesirable vessel motion, typically wave-induced motion.

The invention has been devised particularly, although not necessarily solely, for trimarans configured as high speed commercial and military vessels, such as ferries, for passenger and cargo transport, including vehicle transport.

BACKGROUND ART

The following discussion of the background art is intended to facilitate an understanding of the present invention only. The discussion is not an acknowledgement or admission that any of the material referred to is or was part of the common general knowledge as at the priority date of the application.

Where sea-going vessels are designed for high speeds, it is generally desirable for reasons of efficiency to have a hull which is long and thin. However, this leads to a lack of stability and the vessel might easily capsize. Therefore, many high speed vessels are designed with two or more hulls which are long and thin, or long and narrow, and are arranged in such a way as to provide improved stability. Typical examples of such vessels are the two-hulled catamaran and the three hulled trimaran.

The long, thin hull realises the desire for propulsion efficiency with high speed for installed power, but long, thin hulls are easily affected by waves, and vessel motions can become undesirably excessive. The reason for this concerns the area and the moment of inertia of the waterplane of the vessel. A vessel with a high waterplane area and moment of inertia will resist motions more easily than one with a smaller waterplane area and moment of inertia.

A vessel having a relatively thin hull will have a smaller waterplane area and moment of inertia, and it follows that such a vessel will be more susceptible to wave-induced motion.

However, a vessel that is easily set into motion by waves is conversely easily restrained against such movement by the addition of surfaces mounted perpendicular to the direction of wave-induced motion, which is generally vertically.

It is known to configure a trimaran as a high-speed ferry having a long, thin main hull and two smaller long, thin side hulls (amahs), which provide the necessary stability to the whole vessel to prevent capsizing. Pitching motion of the trimaran may be controlled by the generation of vertical forces produced by an active hydrofoil mounted at the bow of the main hull, in a similar fashion to similar active hydrofoils mounted at the bows of various catamarans. To restrict the trimaran vessel from rolling in waves, anti-roll fins have been fitted on each side of the main hull. These anti-roll fins are essentially moving hydrofoils, similar to the corresponding devices fitted to more conventional monohull vessels.

Anti-roll fins are effective in reducing roll, but they have an unwanted side effect in that they will also generate forces in unwanted directions when the vessel is rolling; specifically, they can induce yaw, which will move the vessel off the selected course, as well as a small component of sway. The yawing and sway forces are the inevitable result of fins which are not horizontal, as the lift generated by a fixed non-horizontal fin when a vessel rolls will have vertical component (reducing rolling) and a horizontal component (increasing yaw and sway).

It is known that it is beneficial in order to reduce rolling to position the fins perpendicular to the line of rolling, which usually results in the anti-roll fins being mounted off the horizontal plane.

Any unwanted yaw forces will require a steering course-correction from the helmsman every time the vessel rolls, which is clearly undesirable.

It is against this background and the problems and difficulties associated therewith, that the present invention has been developed.

DISCLOSURE OF THE INVENTION

According to a first aspect of the invention there is provided a multi-hulled vessel comprising a main hull and at least one side hull to each side of the main hull, each hull having a bow and a stern, and motion control means for providing damping to wave-induced motion, the motion control means comprising a forward motion damping device disposed adjacent the bow of one of the hulls, and an aft motion damping device disposed adjacent the stern of at least one other of the hulls, wherein the second moment of area of the forward motion damping device, in plan view, about the centre of flotation of the multi-hulled vessel is between 5% and 15% of the second moment of area of the waterplane of the multi-hulled vessel, and wherein the second moment of area of each of the aft motion damping devices, in plan view, about the centreline of the multi-hulled vessel is between 2% and 6% of the transverse second moment of area of the waterplane of the multi-hulled vessel.

Preferably, the forward motion damping device disposed adjacent the bow of the main hull and the aft motion damping device disposed adjacent the stern of at least one of the side hulls.

Preferably, there are two aft motion damping devices, each aft motion damping device being disposed adjacent the stern of a respective one of two side hulls on opposite sides of the main hull.

Preferably the multi-hulled vessel is configured as a trimaran having two side hulls on opposed sides of the main hull.

Preferably, each damping device is configured to resist wave-induced motion of the vessel and thereby provide a damping effect.

The damping effect may be to any one or more wave-induced motions including, but not limited to, pitch, roll and yaw.

Each damping device may comprise an underwater hydrofoil, although other damping arrangements are of course possible.

Each underwater hydrofoil may comprise a T-foil involving a horizontally disposed wing foil mounted on the lower end of a strut attached to the respective hull.

Typically each hydrofoil presents a nominally zero angle of attack to the oncoming flow direction in order to reduce drag.

Preferably, each hydrofoil is of a streamlined configuration for drag reduction.

Typically, it is not intended that the hydrofoil generates additional forces opposing wave-induced motion by the production of lift by presenting an angle of attack to the oncoming flow direction. Rather, the hydrofoil is intended to generate resistance to wave-induced motion. However, in certain applications the hydrofoils may also be used to generate lift.

While the hydrofoils are preferably fixed and without moving parts, there may be certain applications where there is provision for active control, such as through provision of active surfaces responsive to a control system to facilitate adjustment in accordance with changing conditions. With such an arrangement, the hydrofoils may be utilised to provide lift and/or provide a steering or directional control function.

Each hydrofoil may be located in relation to the respective hull to be accessible for maintenance or repair while the trimaran is afloat. In one arrangement, the hydrofoil may be readily detachable from the hull. In another arrangement, the hydrofoil may be accessible for maintenance or repair without requiring detachment from the hull. In the latter arrangement, the hydrofoil at the stern of each side hull may be adapted to be selectively movable upwardly into a position where it is readily accessible to personnel operating from the hull. In this way, maintenance operations can be performed on the hydrofoils without necessitating dry-docking of the vessel.

Typically, the size of the motion damping device in the horizontal plane is a compromise between that needed to adequately dampen the multi-hulled vessel without creating excessive resistance to forward speed. The size required to adequately dampen the multi-hulled vessel motion is given by the ratio of the second moment of areas of the motion damping devices, in plan view, to the second moment of area of the waterplane of the multi-hulled vessel. Considering longitudinal motion (pitching), the second moment of area of the forward motion damping device about the centre of floatation of the vessel is be between 5% and 15% of the second moment of area of the waterplane of the multi-hulled vessel. Considering transverse motion (rolling), the second moment of area of each of the motion damping devices about the centreline of the multi-hulled vessel is be between 2% and 6% of the transverse second moment of area of the waterplane of the multi-hulled vessel.

According to a second aspect of the invention there is provided a multi-hulled vessel comprising a main hull and at least one side hull to each side of the main hull, each hull having a bow and a stern, and motion control means for providing damping to wave-induced motion, the motion control means comprising a forward motion damping device disposed adjacent the bow of the main hull, and an aft motion damping device disposed adjacent the stern of at least one side hull on each side of the main hull, wherein the second moment of area of the forward motion damping device, in plan view, about the centre of flotation of the multi-hulled vessel is between 5% and 15% of the second moment of area of the waterplane of the multi-hulled vessel, and wherein the second moment of area of each of the aft motion damping devices, in plan view, about the centreline of the multi-hulled vessel is between 2% and 6% of the transverse second moment of area of the waterplane of the multi-hulled vessel.

According to a third aspect of the invention there is provided a trimaran comprising a main hull and two side hulls each having a bow and a stern, and motion control means for providing damping to wave-induced motion, the motion control means comprising a forward motion damping device disposed adjacent the bow of the main hull, and two aft motion damping devices disposed one adjacent the stern of each side hull, wherein the second moment of area of the forward motion damping device, in plan view, about the centre of flotation of the tirmaran is between 5% and 15% of the second moment of area of the waterplane of the trimaran, and wherein the second moment of area of each of the aft motion damping devices, in plan view, about the centreline of the trimaran is between 2% and 6% of the transverse second moment of area of the waterplane of the trimaran.

Preferably, the motion damping devices are so mounted that the features thereof which have a damping effect on roll are disposed horizontally such that yawing forces are substantially reduced (typically to near-zero) when the vessel is rolling.

BRIEF DESCRIPTION OF THE DRAWINGS

The invention will be better understood by reference to the following description of one specific embodiment thereof as shown in the accompanying drawings in which.

BEST MODE(S) FOR CARRYING OUT THE INVENTION

Figure 1:
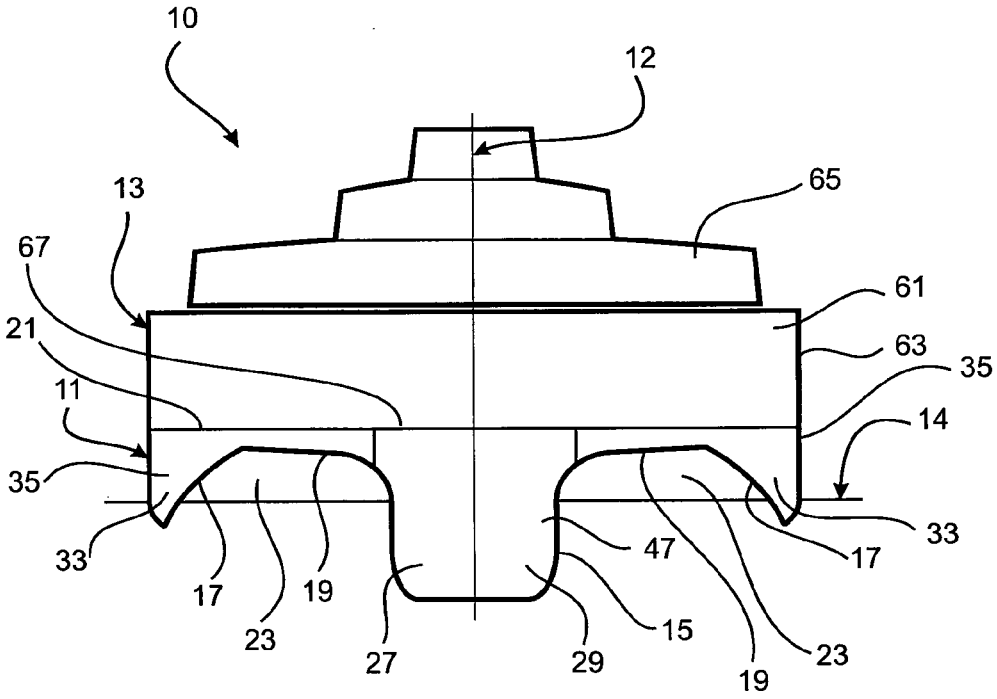
FIG. 1 is a schematic rear elevation of a multi-hulled vessel according to the embodiment configured as a trimaran having a main hull and two side hulls.

The embodiment shown in the drawings is directed to a multi-hulled vessel configured as a trimaran 10. The trimaran 10 according to the embodiment is a high speed, commercial, sea-going vessel operating as a ferry for passenger, and pargo transport, including. in particular vehicle transport, or as a military vessel. Typically, the trimaran is of a size in the order of 80 to 130 meters, although it is of course not limited thereto.

Figure 2:
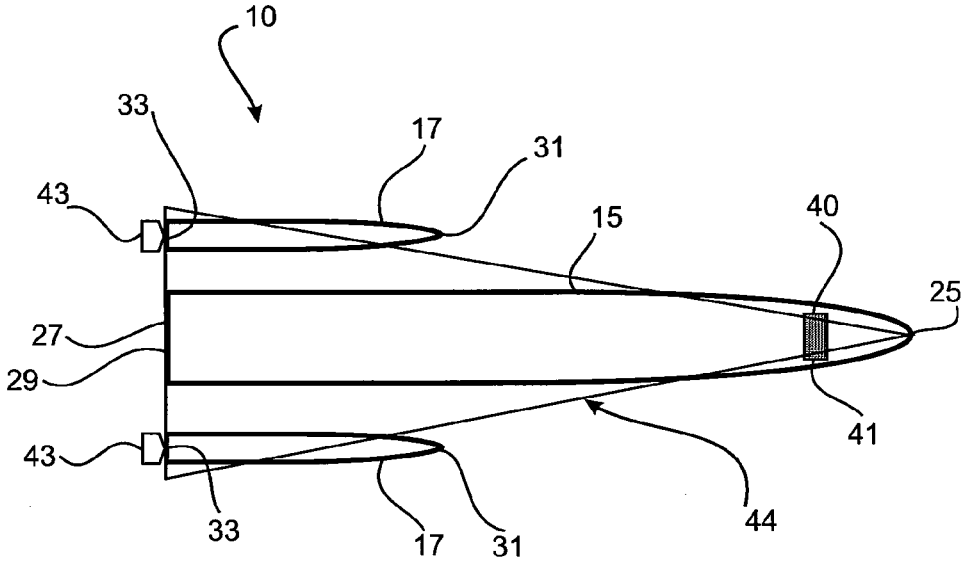
FIG. 2 is a schematic plan view of the main hull and two side hulls, illustrating in particular motion dampening devices.
Figure 3:
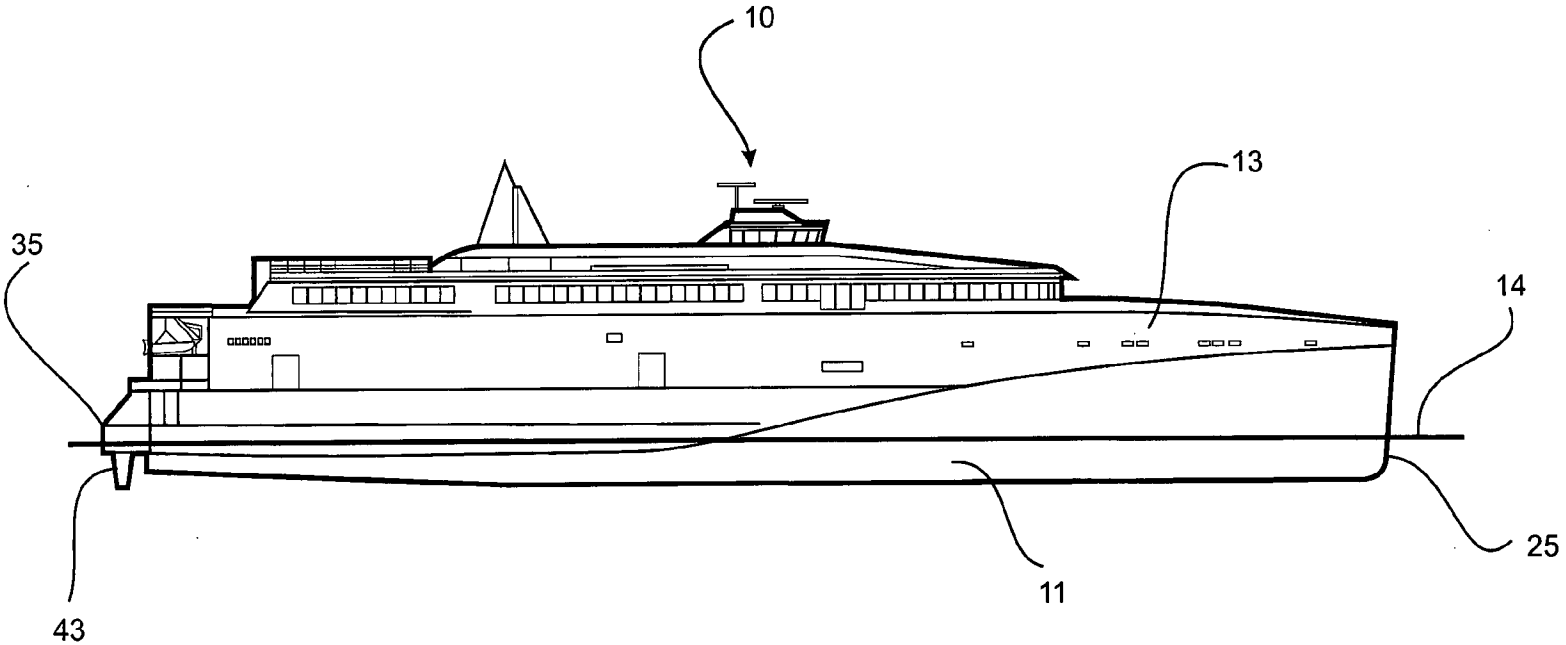
FIG. 3 is a schematic side view of the vessel.

The trimaran 10 comprises an understructrue 11 and a superstructure 13. In this embodiment, the understructrue 11 and superstructure 13 are both constructed primarily of aluminium, although of course any other appropriate construction materials may be used. The waterline in relation to the understructure 11 is identified in FIGS. 1, 2 and 3 by reference numeral 14. The centreline of the trimaran is identified by reference numeral 12.

The under structure 11 comprises a centrally located main hull 15 and two laterally spaced side hulls 17, commonly known as amahs.

The under structure 11 further comprises two integral bridge structures 19 interconnecting the main hull 15 and the two side hulls 17. The bridge structures 19 and the hulls 15, 17 cooperate to provide a deck surface 21 above which the superstructure 13 is located. The bridge structure 19 and the hulls 15, 17 cooperate to provide two tunnels 23 on opposed sides of the main hull 15.

The main hull 15 has a forward end terminating at a bow 25 and an aft end terminating at a stern 27 configured as a transom 29. Similarly, each side hull 17 has a forward end terminating at a bow 31 and an aft end terminating at a stern 33 configured as a transom 35.

A propulsion system (not shown) is provided for delivering propulsive power to the main hull 15. The propulsion system comprises propulsion devices such as steerable water jets 42 at the stern 27 of the main hull 15.

The trimaran 10 is provided with motion control means 40 for providing damping to wave-induced motion, thereby offering ride control.

The motion control means 40 comprises a forward motion damping device 41 disposed adjacent the bow 25 of the main hull 15, and two aft dampening devices 43 disposed one adjacent the stern 33 of each side hull 17. With this arrangement, one of the motion damping devices 41, 43 is located at or near each apex of a notional triangular envelope of the trimaran 10, as depicted by reference numeral 44 in FIG. 2.

Each motion damping device 41, 43 is configured to resist wave-induced motion of the trimaran and thereby provide a damping effect. The overall damping effect includes damping of pitch, roll and yaw.

In this embodiment, each motion damping device 41, 43 comprises an underwater hydrofoil 45, although other damping arrangements are of course possible.

Each underwater hydrofoil 45 comprises a T-foil involving a horizontally disposed wing foil 47 mounted on the lower end of a strut 48 attached to the respective hull. The wing foil 47 is configured similar to a NACA foil section and the strut 48 is relatively long to ensure retention of the wing foil 47 below the waterline in all sea conditions typically encountered.

Figure 4:
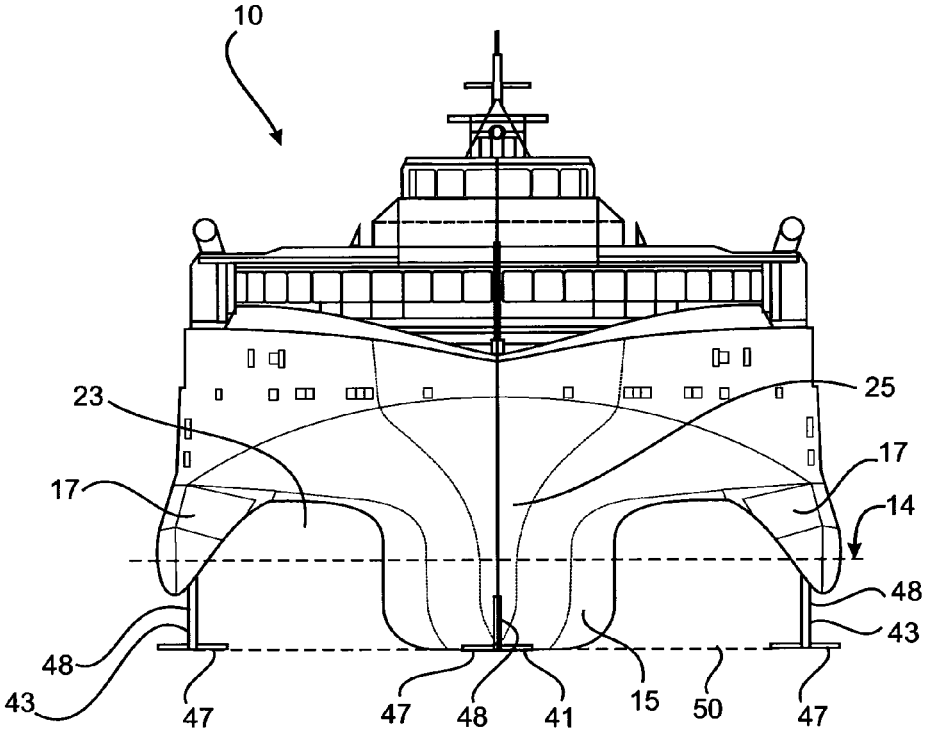
FIG. 4 is a schematic front elevation of the vessel.
Figure 5:
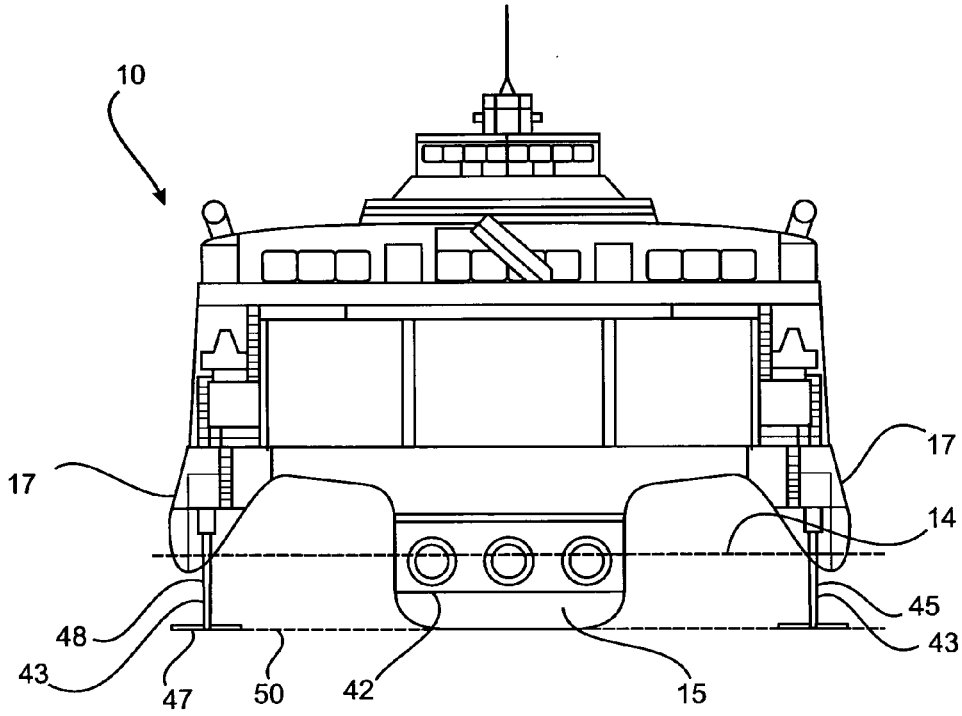
FIG. 5 is a further schematic rear elevation of the vessel.

In the arrangement illustrated, the hydrofoils 45 are so positioned on the hulls 15, 17 that the respective wing foils 47 are at a common depth, as depicted by broken line identified by reference numeral 50 in FIG. 4. In another arrangement, the wing foil 47 of the hydrofoil 45 on the main hull 15 may be at a different depth from the wing foils 47 of the hydrofoils 45 on the side hulls 17.

Each hydrofoil 45 is fixed and disposed to present a nominally zero angle of attack to the oncoming flow direction in order to reduce drag and is also of a streamlined configuration for drag reduction.

Each hydrofoil 45 is so positioned in relation to the respective hull 15, 17 as to be accessible for maintenance or repair while the trimaran 10 is afloat. In one arrangement, the hydrofoils 45 are readily detachable from the respective hulls 15, 17. In another arrangement, the hydrofoil 45 at the stern 33 of each side hull 17 is adapted for selectively swinging movement into a position where it is readily accessible to personnel operating from the hull.

In this embodiment, the size of each hydrofoil 45 in the horizontal plane is a compromise, having regard to the size required to adequately dampen vertical motion of the trimaran 10 without creating excessive resistance to forward speed. The size required to adequately dampen the trimaran motion is given by the ratio of the second moment of areas of the hydrofoils 45, in plan view, to the second moment of area of the waterplane of the trimaran.

In relation to longitudinal motion (pitching), the second moment of area of the hydrofoil functioning as the forward motion damping device 41 about the centre of floatation of the vessel is between 5% and 15% of the second moment of area of the waterplane of the trimaran.

In relation to transverse motion (rolling), the second moment of area of each hydrofoil functions as one of the aft motion damping devices 43 about the centreline of the trimaran is between 2% and 6% of the transverse second moment of area of the waterplane of the trimaran.

From the foregoing, it is evident that the present embodiment provides a simple yet highly effective arrangement for damping wave-induced motions. Each motion damping device functions in a passive state to simply resist wave-induced motion of the trimaran and thereby provide a damping effect to wave-induced motions.

It should be appreciated that the scope of the invention is not limited to the scope of the embodiment described, and that various changes and modification may be made without departing from the scope of the invention.

By way of example, in the embodiment described, it is not intended that the motion damping devices 41, 43 generate additional forces opposing wave-induced motion by the production of lift by presenting an angle of attack to the oncoming flow direction. Rather the motion damping devices 41, 43 are simply intended to generate resistance to wave-induced motion. However, in other embodiments the motion damping devices 41, 43 may also be used to generate lift.

Further, in the embodiment described, the motion damping devices 41, 43 are fixed and without moving parts. However, in other embodiments the motion damping devices 41, 43 may be configured for active control, such as through provision of active surfaces responsive to a control system to facilitate adjustment in accordance with changing conditions. In particular, the aft motion control devices 43 may be provided with active surfaces to offer a steering or directional control function to augment the steering function provided by the steerable water jets 42.

In the embodiment described and illustrated, the forward motion damping device 41 is disposed adjacent the bow 25 of the main hull 15, and two aft dampening devices 43 are disposed one adjacent the stern 33 of each side hull 17. Other arrangements are possible; for example, there may be two forward motion damping devices 41 is disposed one adjacent the bow 31 of each side hull 17, and one aft dampening device 43 are disposed one adjacent the stern 27 of the main hull 15.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The claim defining the invention is as follows:

1. A multi-hulled vessel comprising a main hull and at least one side hull to each side of the main hull, each hull having a bow and a stern, and motion control means for providing damping to wave-induced motion, the motion control means comprising a forward motion damping device disposed adjacent the bow of one of the hulls, and an aft motion damping device disposed adjacent the stern of at least one other of the hulls, wherein the second moment of area of the forward motion damping device, in plan view, about the center of flotation of the multi-hulled vessel is between 5% and 15% of the second moment of area of the waterplane of the multi-hulled vessel, and wherein the second moment of area of each of the aft motion damping devices, in plan view, about the centerline of the multi-hulled vessel is between 2% and 6% of the transverse second moment of area of the waterplane of the multi-hulled vessel.

2. The multi-hulled vessel according to claim 1 wherein each damping device is configured to resist wave-induced motion and thereby provide a damping effect.

3. The multi-hulled vessel according to claim 1 wherein the forward motion damping device is disposed adjacent the bow of the main hull and the aft motion damping device is disposed adjacent the stern of at least one of the side hulls.

4. The multi-hulled vessel according to claim 3 wherein there are two aft motion damping devices, each aft motion damping device being disposed adjacent the stern of a respective one of two side hulls on opposite sides of the main hull.

5. The multi-hulled vessel according to claim 1 wherein each damping device comprises an underwater hydrofoil.

6. The multi-hulled vessel according to claim 5 wherein each underwater hydrofoil comprises a T-foil involving a horizontally disposed wing foil mounted on the lower end of a strut attached to the respective hull.

7. The multi-hulled vessel according to claim 5 wherein each hydrofoil presents a nominally zero angle of attack to the oncoming flow direction in order to reduce drag and is also of a streamlined configuration for drag reduction.

8. The multi-hulled vessel according to claim 5, wherein each hydrofoil is located in relation to the respective hull to be accessible for maintenance or repair while the multi-hulled vessel is afloat.

9. The multi-hulled vessel according to claim 8 wherein each hydrofoil is readily detachable from the hull.

10. The multi-hulled vessel according to claim 8 wherein the hydrofoil at the stern of each side hull is adapted to selectively move upwardly into a position where it is readily accessible to personnel operating from the hull.

11. A multi-hulled vessel according to claim 1 of aluminum construction.

12. A multi-hulled vessel comprising a main hull and at least one side hull to each side of the main hull, each hull having a bow and a stern, and motion control means for providing damping to wave-induced motion, the motion control means comprising a forward motion damping device disposed adjacent the bow of the main hull, and an aft motion damping device disposed adjacent the stern of at least one side hull on each side of the main hull, wherein the second moment of area of the forward motion damping device, in plan view, about the center of floatation of the multi-hulled vessel is between 5% and 15% of the second moment of area of the waterplane of the multi-hulled vessel, and wherein the second moment of area of each of the aft motion damping devices, in plan view, about the centerline of the multi-hulled vessel is between 2% and 6% of the transverse second moment of area of the waterplane of the multi-hulled vessel.

13. A trimaran comprising a main hull and two side hulls each having a bow and a stern, and motion control means for providing damping to wave-induced motion, the motion control means comprising a forward motion damping device disposed adjacent the bow of the main hull, and two aft motion damping devices disposed one adjacent the stern of each side hull, wherein the second moment of area of the forward motion damping device, in plan view, about the center of floatation of the trimaran is between 5% and 15% of the second moment of area of the waterplane of the trimaran, and wherein the second moment of area of each of the aft motion damping devices, in plan view, about the centerline of the trimaran is between 2% and 6% of the transverse second moment of area of the waterplane of the trimaran.

* * * * *